United States Patent [19]

Price et al.

[11] Patent Number: 4,744,699

[45] Date of Patent: May 17, 1988

[54] SINGLE-PASS ROOF BOLT AND APPARATUS AND METHOD FOR INSTALLATION

[75] Inventors: William S. Price, Irving, Tex.; Timothy W. Saunders, Belmont, Calif.

[73] Assignee: Baker International Corporation, Houston, Tex.

[21] Appl. No.: 864,929

[22] Filed: May 19, 1986

[51] Int. Cl.[4] ..... E21D 20/02

[52] U.S. Cl. ..... 405/260; 405/261; 405/303

[58] Field of Search ..... 405/236, 258–262, 405/288, 303; 175/410, 411, 417

[56] References Cited

U.S. PATENT DOCUMENTS

| | | | |
|---|---|---|---|
| 3,653,217 | 4/1972 | Williams | 405/260 |
| 3,861,155 | 1/1975 | Steinberg et al. | 405/260 |
| 4,055,051 | 10/1977 | Finney | 405/261 |
| 4,190,128 | 2/1980 | Emmerich | 175/410 |
| 4,278,363 | 7/1981 | Choi | 405/260 |
| 4,378,997 | 4/1983 | Kasama et al. | 405/260 X |
| 4,398,850 | 8/1983 | Talvensaari | 405/261 |
| 4,564,315 | 1/1986 | Rozanc | 405/260 X |

FOREIGN PATENT DOCUMENTS

| | | | |
|---|---|---|---|
| 790483 | 2/1958 | United Kingdom | 405/260 |
| 542000 | 3/1977 | U.S.S.R. | 405/261 |

*Primary Examiner*—Dennis L. Taylor
*Attorney, Agent, or Firm*—Carl A. Rowold

[57] ABSTRACT

A single-pass roof bolt adapted to drill and to be secured in a bore in the roof of a mine for supporting the roof comprising a tubular body open at one end thereof, constituting the inner end of the bolt, and a cutting structure at the opposite end of the tubular body, constituting the outer end of the bolt. The bolt is adapted to drill a bore in the mine roof upon rotation of the bolt, with the cutting structure being wider than the tubular body for forming an annulus between the tubular body and the wall of the bore. The bolt has a head at its inner end to facilitate rotation of the bolt, and to bear against the mine proof in pressurized relationship. The tubular body further has a transfer port at its outer end, and is free of flow obstructions between its ends, whereby during drilling air is flowable through the bolt for removing cuttings from the bore, and upon completion of drilling grouting material from a source external to the roof bolt may be delivered to the annulus via the transfer port for securing the bolt in the bore. A roof bolting system including a machine for rotating, applying force and delivering the grouting material to the bolt to install it is also disclosed. In addition, a method of installing the bolt is disclosed.

15 Claims, 3 Drawing Sheets

FIG. 4
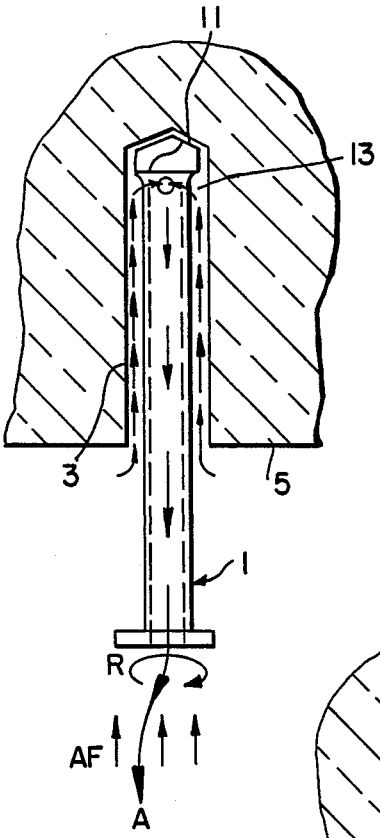
FIG. 5
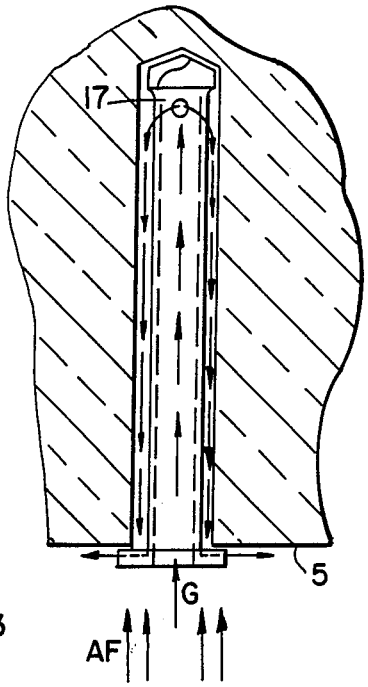
FIG. 6
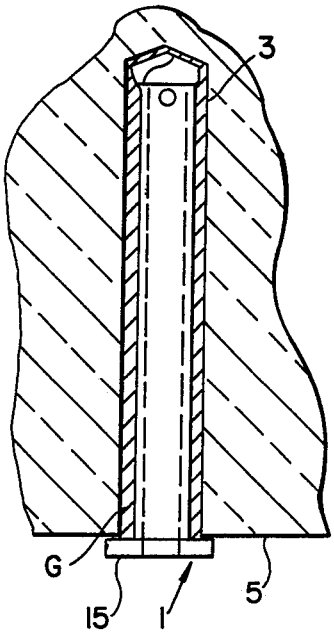
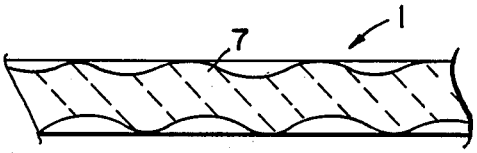
FIG. 10

SINGLE-PASS ROOF BOLT AND APPARATUS AND METHOD FOR INSTALLATION

BACKGROUND OF THE INVENTION

This invention relates to roof bolting for mines, and more particularly to so-called grouted roof bolts that are secured in a bore in a mine roof by a hardenable grouting material bonding the bolt in the bore for supporting the mine roof, and to machines and methods for installing such bolts.

The roof bolt of this invention involves an improvement over grouted roof bolts of the single-pass type, such as shown for example in U.S. Pat. No. 4,055,051, having a tubular body, a cutting structure closing the tube at the upper end thereof, a head at the lower end thereof, packages of a two-component resin grouting material in the tubular body, and an outlet port in the upper end of the tube for discharge of the resin material. This bolt is installed by positioning the head of the bolt in a chuck or other suitable engagement device of a bolting machine, rotating the bolt by turning the head, applying upward force to the bolt via its head during rotation for drilling the bore, pushing a piston into the tubular body to extrude the resin through the outlet port into the annulus between the bolt and the bore in the mine roof, and holding the upward force on the bolt until the resin sets. While bolts of the single-pass type hold out a significant advantage over other grouted bolts; namely, a single bolt serves the three functions of drilling the bore, directing the resin to the annulus and supporting the roof, such bolts have certain accompanying problems which have apparently limited their wide usage in the mining industry. Indeed, applicant knows of no commercial usage of roof bolts of this type.

Among the problems and drawbacks associated with such roof bolts is the lack of an adequately sized passage in the tubular body to enable flow of air to remove drilling debris and cuttings from the bore. The containment of such cuttings, which may be in the form of dust, generated in drilling is necessary not only for respiratory health reasons for miners, but also to minimize explosion risks, particularly in coal mines, as coal dust is highly explosive. While an air passage is provided in the bolt of U.S. Pat. No. 4,055,051, its cross-sectional area is limited by the fact that in the relatively small volume in the tubular body there must also be room for a quantity of resin sufficient to fill the annulus around the bolt. For example, for a bolt formed of tubular stock of conventional one-eighth inch wall thickness to be secured in a bore with an annular one-eighth inch grouting material thickness between the bolt and the bore for adequate bonding strength, the tubular bolt body must be one and one-half inch diameter to provide sufficient volume for the grouting material and an air passage of at least one-half inch diameter. An air passage of this size is considered to be the minimum that will allow drilling chips and dust to pass. Conventional grouted roof bolts of solid bar stock are of one-half to three-quarters inch diameter. Thus, a mining machine cannot carry as many single-pass bolts as it can conventional bolts. And each single-pass bolt requires considerably more drilling time than does a conventional bolt because of its larger bore. Moreover, manufacturing drill bits of this type, so that the packages of resin are secured in the tubular body free of any folds, bends or kinks along the entire length of the bolt, typically some three feet, which could present an air flow obstruction, likely is difficult, costly and time-consuming.

Another difficulty is that the use of such bolts, in a manner that will gain the full advantage thereof, is limited to only mines having a relatively high roof, for example seven or eight feet and perhaps more. This is due to the fact that at the initiation of drilling with the upper end of the bolt in engagement with the mine roof, there must be sufficient vertical space in the mine to accommodate the bolt itself, the piston and piston rod, and the drill chuck and associated drive mechanism, all stacked on top of each other as shown in FIG. 2 of U.S. Pat. No. 4,055,051. As indicated previously, the bolt is often three feet long, and the piston and rod is of approximately an equal length. Unfortunately, many mines in the United States, and particularly coal mines in the eastern United States where grouted roof bolts are widely used, do not have such high roof mines.

The roof bolting system of this invention also involves an improvement over roof bolts and roof bolting machines of the type shown for example in U.S. Pat. No. 4,398,850 having a two-position roof bolting turret which in a first position rotates and advances a drill bit, withdraws the bit and delivers packages of a two-component resin material into the bore, and which in a second position inserts the roof bolt in the bore, rotates the bolt to mix the resin components and holds the bolt pressed against the mine roof until the resin sets. While such roof bolting machines and the older design three-position turret roof bolting machines are widely used in the mining industry, they are relatively complex and expensive, and the subject of considerable maintenance. More importantly, since labor costs for installing bolts is the most expensive factor in roof bolting, the operation of these machines involves significant periods of non-productive time in the transition from one position of the turret to the next. This lengthens the time required for bolt installation, as compared to that for a single-pass roof bolt. More particularly, in the operation of a two-position turret machine, after the bore has been drilled, non-productive time is expended in withdrawing the drill bit. And after the delivery of the packages of grouting material, non-productive time is expended in indexing the turret to its second position and in inserting the roof bolt in the bore. For three-position turret machines, in which drilling and delivery of grouting material are done at separate turret positions, there is the added delay of indexing the turret from its first to its second position.

SUMMARY OF THE INVENTION

Among the several objects of this invention may be noted the provision of an improved roof bolt capable of single-pass installation; the provision of such a roof bolt which may be made of significantly smaller diameter than prior single-pass roof bolts; the provision of such a roof-bolt which is more economical to manufacture and can be more quickly installed than prior single-pass roof bolts; the provision of such a roof bolt which can be utilized in mines having much lower roofs than prior single-pass roof bolts; the provision of a roof bolting system that enables faster overall bolt installation than prior roof bolting systems; the provision of such a bolting system that utilizes a single-position turret bolting machine for reduced capital costs and elimination of non-productive turret indexing time; the provision of such a bolting system in which grouting material is held in flowable form external to the bolt until needed for eliminating packaging costs for the grouting material and reducing the time for delivering and mixing the grouting material; and the provision of an improved method for the installation of single-pass roof bolts.

In general, a single-pass roof bolt of this invention comprises a tubular body open at one end thereof constituting the inner end of the bolt and a cutting structure at the opposite end of the tubular body constituting the outer end of the bolt. The bolt is adapted to drill a bore in a mine roof upon rotation of the bolt and the application of an axial force for advancing the bolt into the mine roof. The cutting structure is wider than the tubular body for forming an annular space between the tubular body and the wall of the bore. The bolt further includes a head at the inner end thereof adapted to be engaged by means for rotating and applying axial force of the bolt to drill said bore and to bear against the mine roof in pressurized relationship, when the roof bolt is secured in the bore. The tubular body further has a transfer port at its outer end and is of generally uniform internal cross-sectional shape along its length. Thus, the tubular body is free of flow obstructions between its inner end and the transfer port. During drilling, air is thus flowable through the bolt for removing cuttings from the bore and upon completion of drilling grouting material from a source external to the roof bolt may be delivered to the annular space via the tubular body and the transfer port for securing the bolt in the bore.

The roof bolting system of this invention includes a roof bolting machine comprising means for releasably holding the roof bolt, means for rotating the roof bolt, means for applying axial force to the roof bolt, a supply of a flowable grouting material adapted to harden in a relatively short time period in a bore in a mine roof and means for selectively delivering a charge of grouting material under pressure to the roof bolt.

The method of this invention of installing a single-pass roof bolt in the roof of a mine comprises the steps of providing the roof bolt, positioning the roof bolt with its outer end in engagement with the mine roof, thereafter rotating the roof bolt and applying axial force to the roof bolt while being rotated to drill a bore in the mine roof. The method further includes the steps of stopping rotation of the roof bolt upon completion of drilling while maintaining force on the roof bolt for pressing the roof bolt head against the mine roof in pressurized relationship, and with the head still pressed against the mine roof delivering a charge of relatively fast hardening grouting material under pressure from a source external to the roof bolt to the open end of the roof bolt. The grouting material delivered to the roof bolt thus flows through the tubular body and the transfer port and fills the annular bore space around the roof bolt. While the grouting material is hardening the axial force on the bolt pressing the head against the mine roof is maintained. Thereafter the axial force is removed from the bolt, with the bolt thus secured in the bore in the mine roof.

Other objects and features will be in part apparent and in part pointed out hereinafter.

BRIEF DESCRIPTION OF THE DRAWINGS

FIG. 4 is a sectional view of a mine roof showing the roof bolt of this invention drilling a bore therein;

FIG. 5 is a view similar to FIG. 4 showing the roof bolt fully penetrated into the roof and grouting material being delivered to the roof bolt and the annulus therearound;

FIG. 6 is a view similar to FIG. 5 showing the grouting material in hardened condition and the bolt thus secured in the mine roof;

FIG. 10 is a partial elevation of an alternative construction of the roof bolt showing ridges thereon.

Corresponding reference characters indicate corresponding parts throughout the several views of the drawings.

DETAILED DESCRIPTION OF THE PREFERRED EMBODIMENTS

Figure 1:
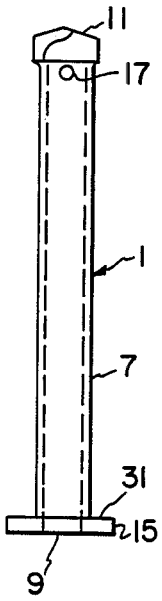
FIG. 1 is a front elevation of a roof bolt of this invention.

Referring to FIG. 1 there is generally indicated at 1 a roof bolt of this invention for drilling a bore 3 in the roof 5 of a mine, for assisting in delivering grouting material to the bore from an external source thereof, and for being secured in the bore for supporting the mine roof, all in a single-pass of the roof bolting machine. The roof bolt 1 comprises a tubular body 7 open at one end 9 thereof, constituting the inner end of the bolt, and a cutting structure 11 at the opposite end thereof, constituting the outer end of the bolt.

Figure 2:
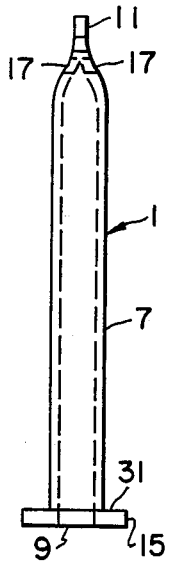
FIG. 2 is a side elevation of the roof bolt.

The cutting structure is adapted to drill the bore 3 in the mine roof 5 upon rotation of the roof bolt and is wider than the body to form an annular space or annulus 13 around the body in the bore. The bolt has a head 15 at its inner end for enabling such rotation of the bolt by the roof bolting machine. At least one transfer port (e.g. two such ports 17 as shown in FIG. 2) is provided in the outer end of the bolt for directing grouting material G delivered from an external source of the material to the annulus 13 around the bolt for securing the bolt in the bore.

More particularly, the tubular body 7 is of circular shape in section, and is formed of a suitable material having acceptable structural strength and machinability but of relatively low cost, such as mild carbon steel. The exterior surface of the body may be of uniform section along its length, such as cylindrical, or may have ridges or projections thereon, such as the helical ridge shown in FIG. 10. This latter exterior configuration provides greater holding power of the bolt grouted in the bore hole. Regardless of the exterior configuration of the bolt, which in turn may affect the interior configuration if, for example, the ridges are formed by roll forming cylindrical tubing, the interior of the bolt must be free of flow obstructions between its inner open end 9 and the transfer port 17 at its outer end. As described more fully hereinafter, and shown in FIGS. 4 and 5, freedom of flow is required to enable air A to flow through the bolt for removing cuttings from the bore during drilling operations, and to deliver grouting material G from an external source thereof to the annular space 13 around the bolt to secure the bolt in the bore.

Figure 8:
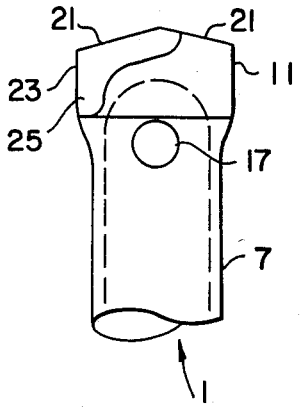
FIG. 8 is an enlarged partial front elevation of the upper end of the roof bolt.
Figure 9:
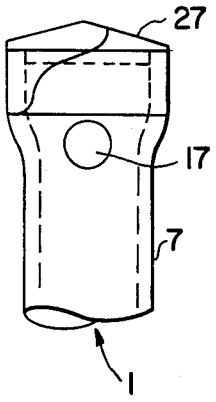
FIG. 9 is a view similar to FIG. 8 of a roof bolt of another construction.

As best illustrated in FIGS. 8 and 9, the cutting structure 11 presents angled cutting edges 21 to facilitate drilling the bore. In the construction of the bolt depicted in FIG. 8, the upper end of the tubular body is crimped closed to form the cutting structure, and the edges machined to extend at an angle to a radial plane through the bolt. To increase the durability of the cutting structure of the bolt, particularly in drilling hard mine roof formations, a coating of suitable hard, wear resistant material 23, such as tungsten carbide or a cobalt alloy such as "Stellite" may be applied to the cutting structure. In addition, to improve the rate of drilling penetration, the edges 21 of the cutting structure may be sharpened as indicated by surface 25 before applying any hard metal thereto. In an alternative construction of the cutting structure as shown in FIG. 9, the tubular body is formed to have an elongated opening at its outer end and an insert 27 of suitable hard metal, such as tungsten carbide or ceramic, is secured in the opening, for example, by brazing or a press fit.

Figure 3:
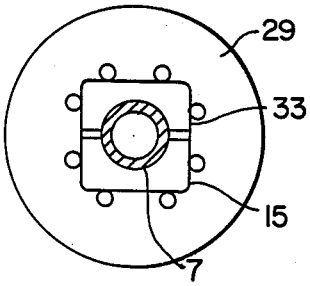
FIG. 3 is a horizontal section of the roof bolt carried on a chuck for rotating the bolt.

The head 15 of the bolt has an opening therein in register with the opening in the lower end 9 of the tubular body. As shown in FIG. 3, the head is preferably of non-circular shape in section and is receivable in a recess of corresponding shape defined on a chuck 29 or other suitable means for rotating the bolt carried on the bolt machine. Alternatively, the head may be of circular shape and releasably held by dogs (not shown) on the chuck. In addition to serving as the bolt element for the rotation and for the application of axial force to the bolt during drilling, the head bears at its outer face 31 (or upper face as shown in the Figs.) against the mine roof in pressurized relationship when secured in the bore for supporting the mine roof 5. As illustrated in FIG. 3, grooves 33 are provided in the outer face of the head forming grout relief ports when the bolt is fully inserted in the bore and grout is delivered under high pressure to the annulus.

Figure 7:
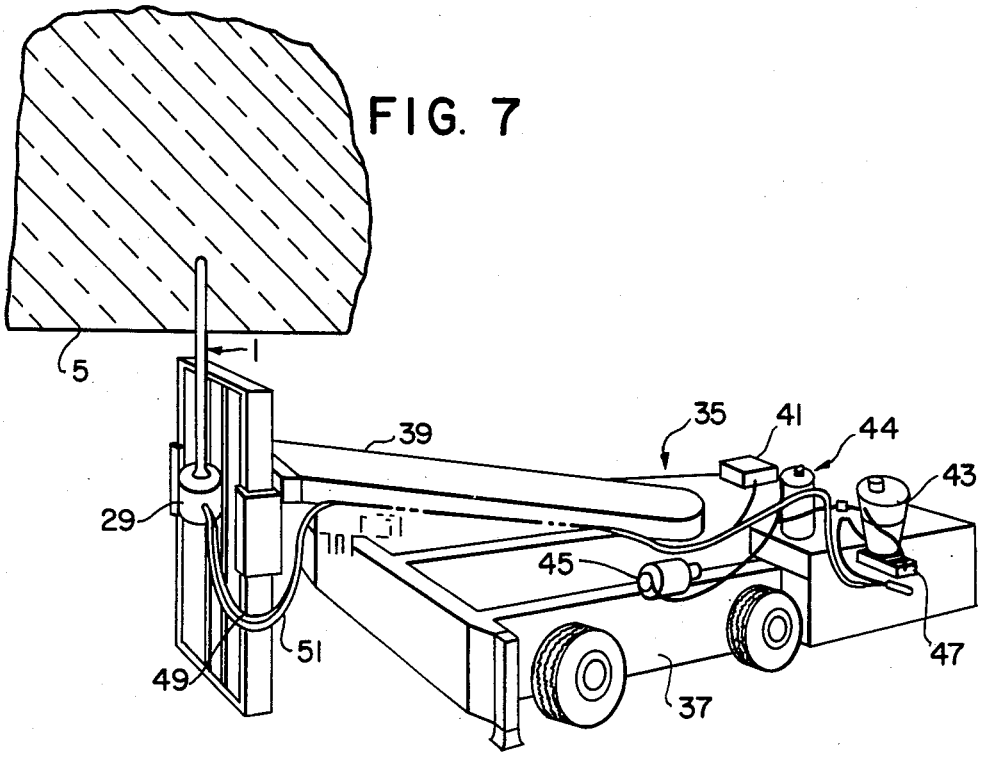
FIG. 7 is a prospective of a roof bolting machine for installing roof bolts in accordance with the method of this invention.

The single-pass roof bolting system of this invention further comprises a unique roof bolting machine 35. The roof bolting machine, as illustrated in FIG. 7 comprises a self-propelled chassis 37 and a highly maneuverable drilling boom 39 for installing roof bolts in different mine roof positions with the vehicle remaining in a single location. The chuck 29 is movably mounted on the boom for movement between a lowered position in which a bolt to be installed may be mounted thereon, and a raised position in which the bolt is fully inserted in the bore and the head of the bolt is pressed against the mine roof in pressurized engagement. Carried on the roof bolting machine and operatively connected to the chuck is air vacuum and dust collection means 41 for withdrawing air with cuttings entrained therein via the chuck, the opening in the head 15, and the tubular bolt body 7 during drilling operations. Also on the roof bolting machine are supplies of a two-part grouting material. Preferably this material is a mixture of gypsum cement and water, with the source 43 of cement being independent of the source 44 of water. The water and the cement are carried by air under pressure from a blower 45 through respective metering devices (both designated 47) and via hoses 49 and 51 to the chuck 29. These components are then mixed at the chuck 29 to form the grouting material G immediately prior to delivery of the grouting material to the open end 9 of the bolt 1. It is also contemplated that the grouting material may also comprise a two-part epoxy resin material, with the components held in bulk in separate supplies until being mixed immediately prior to delivery to the bolt.

As illustrated in the Figs. the supply of grouting material and the means for selectively delivering a charge thereof to the roof bolt are wholly external of the roof bolt and thus are free of engagement with hardened grout in the roof bolt. The chuck 29 and the roof bolting machine 35 can thus be readily disengaged from the roof bolt when the roof bolt is secured in the bore of the mine roof. With the system of this invention, disengagement can occur as soon as a portion of the grouting material in the annular space around the roof bolt hardens for enabling the roof bolting machine to be moved to the next bolt hole drilling location as soon as possible.

In the method of this invention for single-pass securing of roof bolts in the roof of a mine for supporting the mine roof, the bolt 1 is releasably secured to the chuck 29 or other suitable rotating means and moved into engagement with the mine roof. Thereafter, and as best illustrated in FIG. 4, the chuck rotates the bolt as shown by the arrow designated R and applies an upward axial force on the bolt head as represented by the arrows AF in the mine roof. At the same time air, as represented by the arrow A, with cuttings and drilling dust entrained therein is withdrawn from the bore via the transfer ports 17, the passage in the tubular body and the openings in bolt head and chuck. The air is preferably directed to vacuum and dust collection means 41 before being discharged to the atmosphere in the mine to prevent the creation of a potentially explosive or otherwise unsafe working environment.

As illustrated in FIG. 5, when the bore 3 in the mine roof is fully drilled, rotation of the roof bolt is stopped but the axial force AF is retained on the roof bolt for holding the bolt head in pressurized engagement with the mine roof. Thereafter, a freshly mixed quantity of a flowable two-part grouting material G under pressure is delivered to the open inner end 9 of the roof bolt via the chuck 29. The grouting material flows along up the passage in the roof bolt exits the transfer ports 17 and fills the annulus 13. Displaced air from the roof bolt and the annulus is discharged from the bore via the relief grooves 33 in the upper face 31 of the bolt head. Discharge of the relatively viscous grouting material via the grooves 33 occurs when the annulus is completely filled, whereupon delivery of further grouting material is stopped. With the axial force maintained on the bolt head, the grouting material is allowed to harden to secure the roof bolt in the bore. Upon removal of the axial force, the head 15 of the roof bolt remains in pressurized engagement with the mine roof and thus supports the mine.

In the method of this invention, the steps of rotating the roof bolt for drilling the bore in the mine roof, applying axial force to roof bolt, and delivering the charge of grouting material to the roof bolt all are performed with the roof bolt releasably held in the chuck of the bolting machine. Upon at least a portion of the grouting material in the annular becoming hardened so as to hold the roof bolt in the bore hole, the chuck 29 can be disengaged from the roof bolt to enable the roof machine to be moved to the next bolt hole drilling location.

As will be observed from the foregoing, the roof bolt 1 (together with the roof bolting machine 35 and method of this invention) provides for the single pass installation of a fully grouted roof bolt, with less time required for delivery and mixing the grouting material associated with prior art single-pass roof bolts. This minimizes the labor time for installing the roof bolt, which is the most expensive factor in roof bolting costs. In addition, the roof bolt 1 involves no grouting material packaging costs and can be readily and economically machined from low cost, commercially available stock tubing material. Further, the roof bolt 1 may be made of significant smaller diameter, for example, as small as one-half inch inner diameter and approximately three-quarter inch outer diameter, than heretofore possible, for faster drilling and enabling the carrying of more roof bolts on the roof bolting machine.

While the roof bolt 1 has been described and shown as being installed vertically up into a mine roof, it is to be understood that the roof bolt may be installed in inclined or horizontal positions and may be utilized in mine walls or floors. In addition, while the roof bolting machine 35 has been described as having air withdrawal means for drawing air with cuttings entrained therein from the bore, it is to be understood that the roof bolting machine may include a source of air under pressure for delivering air to the annulus for blowing air with cuttings entrained therein out of the annulus. However, in this construction, means for collecting the dust must also be provided around the bolt head to prevent dust creation in the mine.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A roof bolting system adapted both to drill a bore in the roof of a mine and to secure a roof bolt in the bore so formed for supporting the mine roof in a single-pass operation, said system comprising:

a roof bolting machine comprising means for releasably holding a roof bolt, and operatively associated with said means for releasably holding the roof bolt, means for rotating the roof bolt for drilling the bore hole, means for providing drilling air to the roof bolt during drilling operations to remove bore hole cuttings, means for applying axial force to the roof bolt, a supply of a flowable grouting material adapted to harden in a relatively short time period in a bore in a mine roof, and means for selectively delivering a charge of grouting material under pressure to the roof bolt, all of said means operatively associated with said releasable holding means being adapted and intended to perform their respective functions while the roof bolt is held in said releasable holding means, and with said supply of grouting material and said means for selectively delivering a charge thereof to the roof bolt being wholly external of the roof bolt and thus free of engagement with hardened grout in the roof bolt for rapid disengagement of the releasable holding means from the roof bolt upon it being secured in the bore of the mine roof, and a roof bolt comprising:

a tubular body open at one end thereof, constituting the inner end of the bolt;

a cutting structure at the opposite end of the tubular body, constituting the outer end of the bolt, adapted to drill a bore in the mine roof upon rotation of the bolt and the application of an axial force for advancing the bolt into the mine roof, the cutting structure being wider than the tubular body for forming an annular space between the tubular body and the wall of the bore; and a head at the inner end of the bolt adapted to be held by said releasable holding means of the bolting machine for being rotated and advanced axially during drilling and for being pressed against the mine roof in pressurized relationship upon completion of drilling while the grouting material is hardening;

said tubular body further having a transfer port at its outer end, whereby during drilling air is flowable through the tubular body for removing cuttings from the bore, and upon completion of drilling a charge of grouting material from the bolting machine may be injected via the tubular body and the transfer port into the annular bore space around the tubular body for securing the bolt in the bore upon hardening of at least a portion of the grouting material in the annular bore space.

2. A roof bolting system as set forth in claim 1 wherein the means for providing drilling air further comprises means for delivery of air under pressure to the inner end of the tubular body, with the air under pressure during drilling flowing through the transfer port and the annulus around the tubular body for removing the cuttings.

3. A roof bolting system as set forth in claim 1 wherein the means for providing drilling air further comprises air withdrawal means connected to the inner end of the tubular body, with air thus flowing through the annulus, entraining the cuttings, flowing through the transfer port, and exiting the inner end of the tubular body.

4. A roof bolting system as set forth in claim 1 wherein said tubular body is of generally uniform internal cross-sectional shape and thus free of flow obstructions between its inner end and the transfer port.

5. A roof bolting system as set forth in claim 1 wherein the head of the bolt and the means for releasably holding the bolt together constitutes a projection of non-circular shape in section and a recess means of corresponding shape in section for applying rotational and vertical forces to the bolt.

6. A roof bolting system as set forth in claim 5 wherein the means for releasably holding the bolt comprising a rotatable support member having said non-circular recess means at one face thereof, and an opening therein in communication with the open inner end of the tubular member for flow of fluid through the bolt.

7. A roof bolting system as set forth in claim 1 wherein the head of the bolt is of generally circular shape in section and the means for releasably holding the bolt constitutes a chuck.

8. A roof bolting system as set forth in claim 1 wherein the grouting material is a two-component resin, charges of these components being mixed just prior to the delivery of the grouting material to the roof bolt.

9. A roof bolting system as set forth in claim 1 wherein the grouting material is a mixture of cement and water, charges of the cement and water being mixed just prior to the delivery of the grouting material to the roof bolt.

10. A method for single-pass securing of roof bolts in the roof of a mine for supporting the mine roof, each roof bolt comprising a tubular body open at one end thereof, constituting the inner end of the bolt, and having a transfer port at the opposite end thereof, constituting the outer end of the bolt, a cutting structure at the outer end of the bolt so sized as to drill a bore in the mine roof of greater diameter than the width of the tubular member to form an annular space between the tubular body and the wall of the bore, and a head at the inner end of the bolt; said method comprising the steps of:

(A) providing a roof bolt and means for releasably holding the roof bolt;

(B) thereafter positioning the roof bolt in the releasable holding means with the outer end of the roof bolt held in engagement with the mine roof;

(C) thereafter rotating the roof bolt;

(D) applying axial force to the roof bolt while being rotated to drill a bore in the mine roof;

(E) providing drilling air to the roof bolt during drilling operations to remove bore hole cuttings;

(F) stopping rotation of the roof bolt upon completion of drilling, while maintaining force on the roof bolt thereby pressing the bolt head against the mine roof in pressurized relationship;

(G) with the bolt head still pressed against the mine roof, delivering a charge of relatively fast hardening grouting material under pressure from a source and via means wholly external to the roof bolt to the open inner end of the roof bolt, the grouting material flowing through the tubular body, out the transfer port and filling the annular bore space around the roof bolt;

(H) maintaining the axial force on the bolt pressing the head against the mine roof until at least a portion of the grouting material in the annular bore space hardens;

(I) removing the axial force on the bolt; and (J) thereafter disengaging the releasable holding means from the roof bolt.

11. The method set forth in claim 10 wherein the step of providing drilling air further comprises the step of withdrawing air and mine roof cuttings entrained therein via the transfer port and the tubular body during said drilling step.

12. The method set forth in claim 10 wherein the step of providing drilling air further comprises the step of delivering air under pressure to the roof bolt for flow of air through the annulus to remove cuttings from the bore.

13. The method set forth in claim 10 wherein the step of delivering grouting material comprises mixing the components of a two-component resin to form the grouting material prior to delivery of the grouting material to the roof bolt.

14. The method set forth in claim 10 wherein the step of delivering grouting material comprises mixing water and cement to form the grouting material prior to delivery of the grouting material to the roof bolt.

15. The method set forth in claim 10 wherein said releasable holding means is part of a roof bolting machine capable of rotating and applying axial force to the bolt and said steps of rotating, of applying axial force and of delivering a charge of grouting material all being performed with the roof bolt held by the bolting machine.

* * * * *